US009347156B2

(12) United States Patent
Seeger

(10) Patent No.: US 9,347,156 B2
(45) Date of Patent: May 24, 2016

(54) CIRCULAR KNITTING MACHINE WITH EXPANDER

(71) Applicant: SIPRA Patententwicklungs- und Beteiligungsgesellschaft mbH, Albstadt (DE)

(72) Inventor: Stefan Seeger, Jungingen (DE)

(73) Assignee: SIPRA Patententwicklungs-und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 14/287,450

(22) Filed: May 27, 2014

(65) Prior Publication Data

US 2014/0360231 A1 Dec. 11, 2014

(30) Foreign Application Priority Data

Jun. 7, 2013 (DE) ..... 10 2013 105 941

(51) Int. Cl.
*D04B 15/88* (2006.01)

(52) U.S. Cl.
CPC ..... *D04B 15/88* (2013.01)

(58) Field of Classification Search
CPC ..... D04B 15/88
USPC ..... 66/149 R, 150, 151, 153
See application file for complete search history.

(56) References Cited

U.S. PATENT DOCUMENTS

| | | | | |
|---|---|---|---|---|
| 2,751,768 | A | 6/1956 | Lebocey | |
| 3,162,028 | A * | 12/1964 | Egerton et al. | 66/151 |
| 3,616,502 | A * | 11/1971 | Egerton et al. | 66/151 |
| 4,014,187 | A | 3/1977 | Bandoch et al. | |
| 4,055,968 | A | 11/1977 | Bourgeois | |
| 5,575,162 | A * | 11/1996 | Gray et al. | 66/151 |
| 2014/0360231 | A1 * | 12/2014 | Seeger | 66/151 |

FOREIGN PATENT DOCUMENTS

| | | |
|---|---|---|
| DE | 1 228 021 | 11/1966 |
| DE | 24 43 067 a | 3/1975 |
| DE | 26 43 040 | 4/1977 |
| DE | 31 12 181 | 1/1982 |
| GB | 2079 793 | 1/1982 |

* cited by examiner

*Primary Examiner* — Danny Worrell
(74) *Attorney, Agent, or Firm* — Michael J. Striker

(57) ABSTRACT

A circular knitting machine has a circular knitting unit fitted with needles and an expander arranged under the circular knitting unit for tubular knit formed by the circular knitting unit. The expander is rotatably mounted on a central rod arranged coaxially to a knitting machine axis. A pivoting bearing is arranged on the central rod to allow limited swivel movements of the expander relative to the central rod.

7 Claims, 3 Drawing Sheets

CIRCULAR KNITTING MACHINE WITH EXPANDER

CROSS-REFERENCE TO A RELATED APPLICATION

The invention described and claimed hereinbelow is also described in German Priority Document DE 10 2013 105941.4, filed on Jun. 7, 2013. The German Priority Document, the subject matter of which is incorporated herein by reference, provides the basis for a claim of priority of invention under 35 U.S.C. 119(a)-(d).

BACKGROUND OF THE INVENTION

The invention relates to a circular knitting machine with a circular knitting unit fitted with needles and an expander arranged under the circular knitting unit for the tubular knit formed by the circular knitting unit. The expander is rotatably mounted on a central rod arranged coaxially to a knitting machine central axis.

With the expander the tubular knit is formed into a double-layered web laid flat and is then withdrawn and wound up. In this process the knitted fabric exerts considerable forces on the expander. These forces are transferred to the central rod, which can thus result in fatigue fractures of the central rod. Moreover, the forces also can result in folding and ringing of the knitted fabric during winding, which makes further processing difficult.

To remedy this problem document DE 12 28 021 has proposed to suspend the expander on the machine on chains. However, this type of suspension of the expander can lead to a relatively substantial lateral displacement of the expander as a result of the forces exerted by the tubular knit. The lateral displacement makes it difficult to uniformly withdraw and wind up the web.

DE 24 43 067 describes an expander with articulated straps, which are connected to a rigid expander frame by a damper unit. The damper units absorb part of the forces exerted by the tubular knit. This solution, however, is structurally complicated. The damper units suffer fatigue over time and must be regularly replaced.

DE 31 12 181 also discloses expanders with different adjustment possibilities of individual expander parts relative to one another to enable forces exerted by the knitted fabric to be compensated. These solutions, however, also are very complicated structurally.

SUMMARY OF THE INVENTION

The present invention overcomes the shortcomings of known arts, such as those mentioned above.

To that end, the present invention provides a circular knitting machine with an expander, which absorbs forces generated by the tubular knit in a structurally simple manner.

In an embodiment, the invention provides a circular knitting machine with a circular knitting unit fitted with needles and an expander arranged under the circular knitting unit for the tubular knit (formed by the circular knitting unit). The expander is rotatably mounted on a central rod arranged coaxially to a knitting machine central axis. The expander has a pivoting bearing arranged on the central rod that allows limited swivel movements of the expander relative to the central rod.

As a result of the pivoting bearing, the expander can move out of the way of the forces exerted by the tubular knit by swivel movements relative to the central rod to relieve the load on the central rod. However, in contrast to the known chain suspension arrangements of expanders, lateral deflection of the expander does not occur and, therefore, the withdrawal and winding up of the web are not detrimentally affected. Ringing or folding in the web can likewise by avoided by the swiveling expander.

The pivoting bearing is preferably configured as a ball bearing, which allows a uniform movement of the expander in all spatial directions perpendicular to the direction of the longitudinal axis of the central rod. Alternatively, the pivoting bearing is configured as an elastic pivoting bearing. The elastic pivoting bearing is achieved by spring elements or other elastic coupling elements. These elastic bearing elements can absorb forces in the direction of the central rod.

In a first configuration, the expander is arranged rotatably on the central rod by the pivoting bearing, i.e., pivoting and rotating bearings for the expander are arranged in a unit in the region of the lower end of the central rod.

If, however, larger swivel radii of the expander are desired, then the central rod can be divided into an upper and a lower section and the pivoting bearing can be arranged between the upper and the lower section. The longer the lower section of the central rod is selected to be, the larger the possible swivel radius of the expander and thus the greater its ability to move out of the way of forces generated by the knitted fabric.

A coupling arrangement with the pivoting bearing can be arranged between the two central rod sections to connect the sections to one another. This coupling arrangement has a holding element and a fastening element, for example, which are connected to one another by spacer screws. In this case, the holding element is connected to one of the sections of the central rod, e.g., the upper section, and the fastening element is connected to the other section. The pivoting bearing is arranged on the fastening element in this case. Moreover, the spacing between the two central rod sections can be adjusted by the spacer screws.

BRIEF DESCRIPTION OF THE DRAWINGS

Further features and advantages of the invention will become apparent from the description of embodiments that follows, with reference to the attached figures, wherein.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
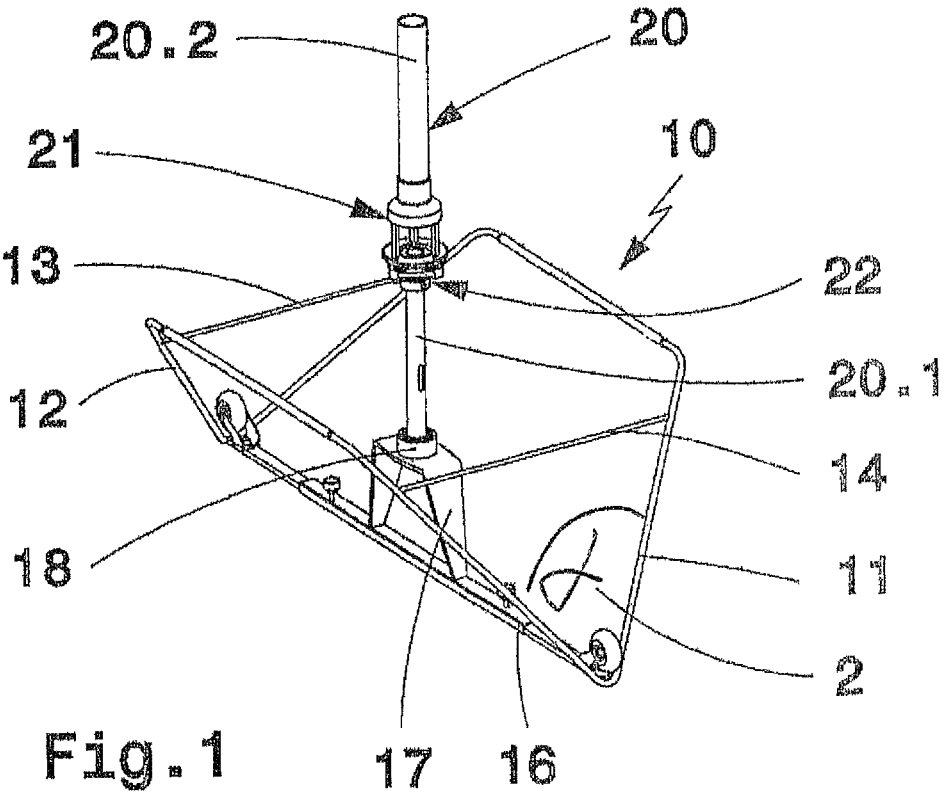
FIG. 1 presents a perspective view of an expander with divided central rod, configured according to the invention.

FIG. 1 shows an expander 10 formed according to the invention with two trapezoidal straps 11, 12, which are connected to one another at a base 16. The trapezoidal straps are held at an angle α relative to one another by means of struts 13, 14, as shown. The length of the base 16 is adjustable and thus adaptable to a diameter of the tubular knit.

The base 16 is connected by a strap 17 and a rotating bearing 18 to a lower section 20.1 of a central rod 20. The central rod 20 is fastened to a machine frame of the circular knitting machine. The central rod 20 is oriented coaxially to a central axis of the circular knitting machine in this case.

Figure 2:
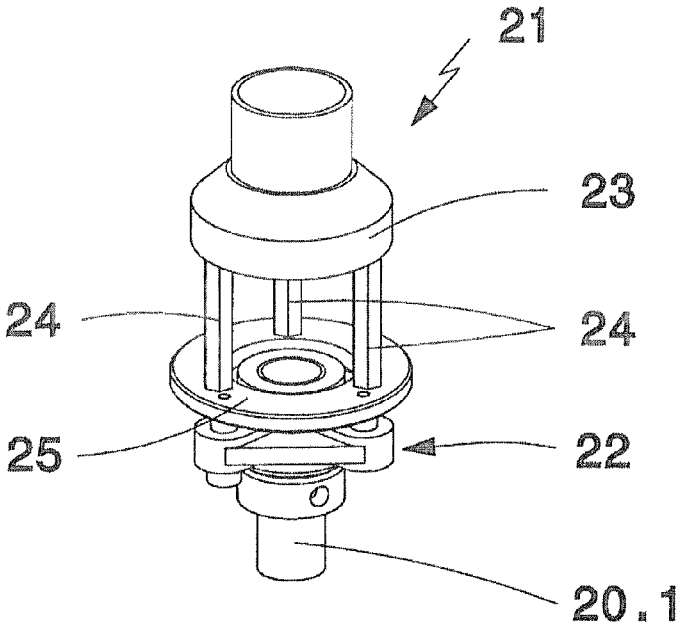
FIG. 2 presents an enlarged detail view of the connection region of the central rod sections of the expander of FIG. 1.
Figure 3:
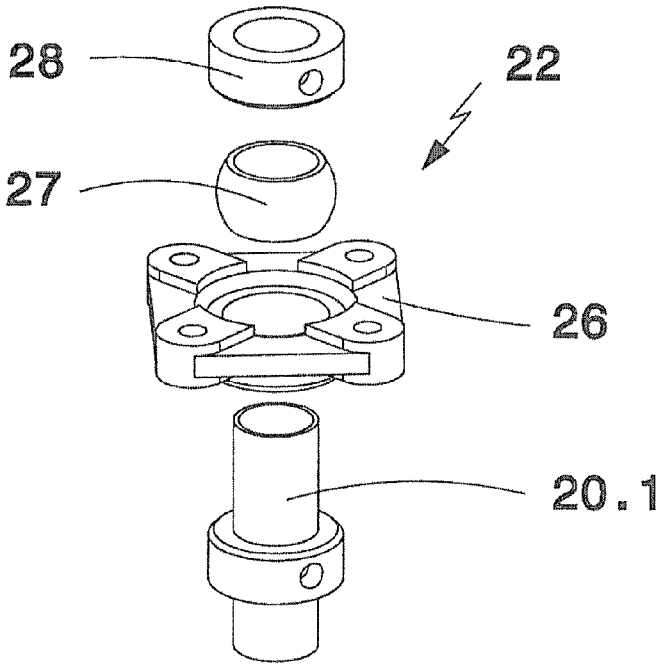
FIG. 3 presents an exploded drawing of a pivoting bearing on the central rod of the expander of FIG. 1.

A coupling unit 21 and a pivoting bearing 22, as shown in FIGS. 2 and 3, respectively, are arranged between the lower section 20.1 of the central rod 20 and an upper section 20.2 of the central rod 20. As result of the pivoting bearing 22, the expander 10 can pivot in relation to the central rod 20 and thus move out of the way of forces that are exerted on it by the tubular knit (not shown) generated by the circular knitting machine. These forces are thus not transferred to the central rod 20. The central rod 20 is thus subject to a significant relief of load as a result of the pivoting bearing 22. Moreover, the flat double-layered web generated from the tubular knit by the expander 10 can be withdrawn and wound up free from tension as a result of the limited pivoting ability of the expander 10.

Coupling unit 21 is shown in FIG. 2 with a holding element 23 that is connectable to the upper section 20.2 of the central rod 20 and, is connected to a ring-shaped fastening element 25 by spacer screws 24. A pivoting bearing 22 and the lower section 20.1 of the central rod 20 are fastened to the underside of the fastening element 25.

Pivoting bearing 22 (FIG. 3) consists of a bearing shell 26, which is screwed to the fastening element 25, a ball 27 and a spacer ring 28. The ball 27 is hollow so that the upper end of the lower central rod section 20.1 is passed through it. The length of the lower central rod section 20.1 determines the swivel radius of the expander 10.

Figure 4:
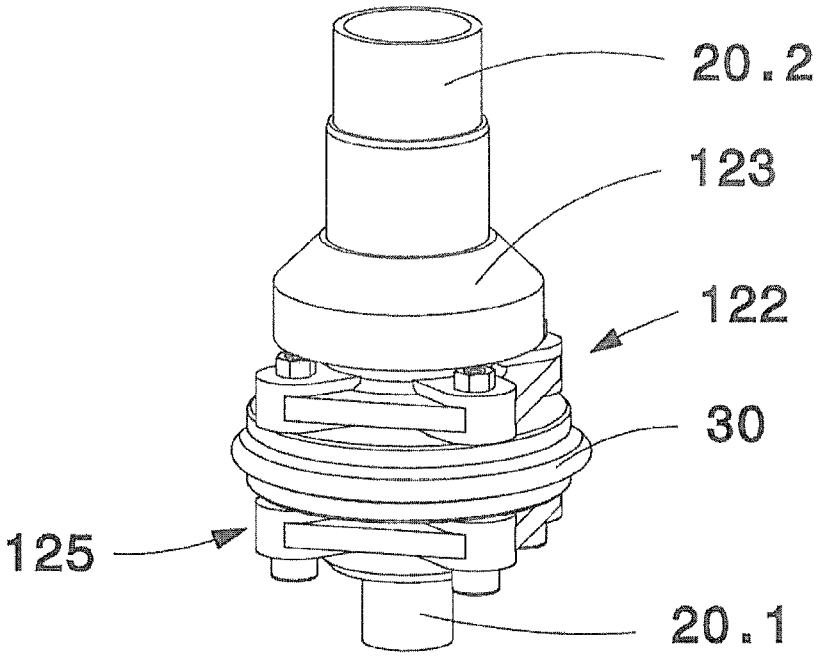
FIG. 4 presents a perspective view of a second connection region of the central rod sections of an expander.

FIG. 4 shows a further embodiment of a pivoting bearing 122, which is arranged between two central rod sections 20.1 and 20.2 of the expander and is configured as an elastic joint. The upper central rod section 20.2 is fastened to a holding element 123, whereas the lower central rod section 20.1 is arranged on a fastening element 125. The holding element 123 and the fastening element 125 are connected to one another by an elastic element 30. The elastic element 30 forms the pivoting bearing 122 and can be made, for example, from rubber, polyurethane or another plastic.

Figure 5:
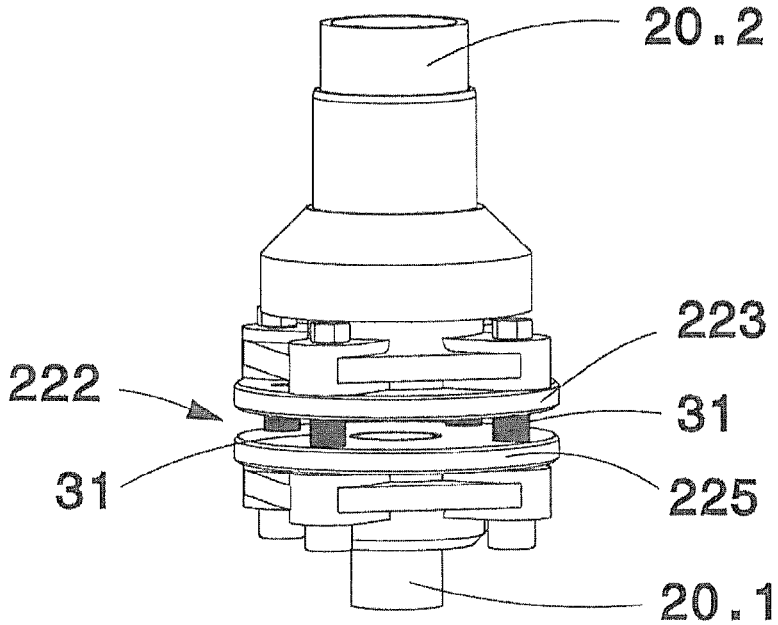
FIG. 5 presents a perspective view of a third connection region of the central rod sections of an expander.

FIG. 5 shows a further elastic pivoting bearing 222, which is formed from four spring elements 31 arranged between a holding element 223, on which the upper central rod section 20.2 is fastened, and a fastening element for the lower central rod section 20.1.

Elastic element 30 and the spring elements 31 of the pivoting bearings 122 and 222 allow a limited swivel movement between the central rod sections 20.1 and 20.2 and thus, also of an expander 10 (FIG. 1) that is fastened to the lower central rod section 20.1.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A circular knitting machine, comprising:

a circular knitting unit fitted with needles configured to form a tubular knit; and an expander arranged under the circular knitting unit for the tubular knit, the expander rotatably mounted on a central rod arranged coaxially to a knitting machine central axis;

wherein a pivoting bearing is arranged on the central rod to allow limited swivel movements of the expander relative to the central rod;

wherein the central rod is divided into an upper and a lower section and the pivoting bearing is arranged between the upper and the lower section; and wherein the limited swivel movements of the expander relative to the central rod, which are imposed by the pivoting bearing, relieve a load imposed by the tubular knit on the central rod.

2. The circular knitting machine according to claim 1, wherein the pivoting bearing is a ball bearing.

3. The circular knitting machine according to claim 1, wherein the pivoting bearing is an elastic pivoting bearing.

4. The circular knitting machine according to claim 1, wherein the expander is rotatably mounted on the central rod by the pivoting bearing.

5. The circular knitting machine according to claim 1, wherein the pivoting bearing includes a coupling arrangement between the central rod upper and lower sections.

6. A circular knitting machine, comprising:

a circular knitting unit fitted with needles configured to form a tubular knit; and an expander arranged under the circular knitting unit for the tubular knit, the expander rotatably mounted on a central rod arranged coaxially to a knitting machine central axis;

wherein a pivoting bearing is arranged on the central rod to allow limited swivel movements of the expander relative to the central rod;

wherein the central rod is divided into an upper and a lower section;

wherein the pivoting bearing is arranged between the upper and the lower sections of the central rod and includes a coupling arrangement between the central rod upper and lower sections; and wherein the coupling arrangement has a holding element and a fastening element that are interconnected by spacer screws.

7. The circular knitting machine according to claim 6, wherein the pivoting bearing is arranged on the fastening element.

* * * * *